US005293738A

United States Patent [19]

Ferro et al.

[11] Patent Number: 5,293,738

[45] Date of Patent: Mar. 15, 1994

[54] DEVICE FOR PICKING UP AND PREPARING THE SKEIN END FOR REJOINING IN AN OPEN-END SPINNING MACHINE

[75] Inventors: Francesco Ferro; Claudio Peruch, both of Pordenone; Donato Castellarin, Azzano Decimo, all of Italy

[73] Assignee: Savio S.p.A., Pordenone, Italy

[21] Appl. No.: 963,279

[22] Filed: Oct. 19, 1992

Related U.S. Application Data

[63] Continuation of Ser. No. 730,686, Jul. 16, 1991, abandoned.

[30] Foreign Application Priority Data

Aug. 1, 1990 [IT] Italy ..... 21159 A/90

[51] Int. Cl.[5] ..... D01H 15/02

[52] U.S. Cl. ..... 57/261; 57/263; 57/264; 57/278

[58] Field of Search ..... 57/22, 261, 263, 264, 57/278, 352; 73/160

[56] References Cited

U.S. PATENT DOCUMENTS

| | | | |
|---|---|---|---|
| 3,037,162 | 5/1962 | Jones et al. | 242/36 |
| 3,899,809 | 8/1975 | Haberkern | 57/261 X |
| 3,924,393 | 12/1975 | Stahlecker et al. | 57/263 |
| 3,924,394 | 12/1975 | Stahlecker | 57/34 R |
| 3,925,975 | 12/1975 | Stahlecker et al. | 57/1 UN X |
| 3,942,311 | 3/1976 | Stahlecker | 57/34 R |
| 3,962,855 | 6/1976 | Stahlecker | 57/263 |
| 4,084,398 | 4/1978 | Stahlecker et al. | 57/264 X |
| 4,248,037 | 2/1981 | Martin et al. | 57/263 |
| 4,327,546 | 5/1982 | Derichs et al. | 57/263 |
| 4,476,671 | 10/1984 | Rohner et al. | 57/261 |
| 4,489,544 | 12/1984 | Morita et al. | 57/263 X |
| 4,539,803 | 9/1985 | Ferro et al. | 57/268 X |
| 4,628,684 | 12/1986 | Morita et al. | 57/263 |
| 4,672,802 | 6/1987 | Raasch | 57/263 |
| 4,920,739 | 5/1990 | Raasch | 57/263 |

FOREIGN PATENT DOCUMENTS

| | | | |
|---|---|---|---|
| 2712644 | 9/1978 | Fed. Rep. of Germany | 57/263 |
| 3225379 | 12/1984 | Fed. Rep. of Germany . | |
| 3418780 | 11/1985 | Fed. Rep. of Germany | 57/263 |
| 1146694 | 8/1981 | Italy . | |

*Primary Examiner*—Daniel P. Stodola
*Assistant Examiner*—William Stryjewski
*Attorney, Agent, or Firm*—George P. Hoare, Jr.

[57] ABSTRACT

An apparatus for delivering a skein end of a thread wound on a reel to an apparatus for returning the skein end to a spinning machine. The apparatus for delivering the skein end comprises a device for unwinding a reel on which the thread is wound, a capturing device for capturing the skein end of the thread, a transferring device to transfer the thread from the capturing device to a device that returns the thread to the spinning machine, and a detecting device for detecting the presence of the thread in the transferring device. Another aspect of the invention generally features an apparatus for rejoining the skein end of a thread wound on a reel, the thread having been disconnected from the reel due to one of a plurality of different events. The apparatus comprises an unwinding device for unwinding the reel; a capturing device for capturing the skein end of the thread wound on the reel, a cutting device for cutting a portion of the thread captured by the capturing device. The size of the cut portion varies in response to which of the plurality of different events caused the thread to become disconnected from the spinning machine; and a rejoining device from rejoining a skein end of the thread remaining on the reel to the spinning machine.

6 Claims, 1 Drawing Sheet

17
13
10
7
12
11 A
16
17
13 A
14

5
4
3
2
7
10
9
8
6
1
13
11
11 A
1
13 A
14

5
4
4
3
2
16
17
15
13
1

DEVICE FOR PICKING UP AND PREPARING THE SKEIN END FOR REJOINING IN AN OPEN-END SPINNING MACHINE

This is a continuation of application Ser. No. 07/730,686, filed Jul. 16, 1991, now abandoned.

BACKGROUND OF THE INVENTION

The present invention relates to open-end spinning and in particular concerns the starting up or resumption of open-end spinning, in which a ring of singularized fibres is placed in the groove of a rotor which turns at extremely high speeds, in which an end of the thread is re-introduced which connects with the singularized fibres placed in the groove.

By extracting the end thus introduced, production of the thread, which is twisted by the rotation of the rotor, is resumed. The thread is extracted by extraction rollers and wound onto reels.

The number of twists imparted to the thread is proportional to the ratio between the speed of the rotor and the thread extraction speed.

In an open-end spinning machine the thread must be rejoined in the starting stage of the spinning machine or, more frequently, when a thread has broken or when production of a new reel is started, having completed the previous reel. In order to perform this operation correctly the end must be reintroduced into the rotor using devices that ensure that a precisely-set length of thread is inserted into the rotor, with controlled times and speeds of the various organs involved.

To produce a good-quality yarn, in the section of thread produced in the joining operation between the end introduced and fibres taken from the rotor, the yarn must not be irregular, must not have a different diameter and must have the same resistance. In other words, in good-quality yarns the sections in which the join has been made must be the same as the rest of the yarn.

If this were not so, the yarn produced would have to undergo an additional spooling operation, to eliminate the imperfections due to irregularities of the diameter or twists, weak points and so on.

To obtain a proper join between the singularized fibres and the end of the thread reintroduced into the rotor with an opposite motion to that of extraction it is known from the state of the art that the said end must be properly prepared, ridding it of existing twists and making the fibres that comprise it essentially parallel, in order to improve the penetration between the fibres of the reintroduced end and the singularized fibres placed in the rotor.

In the known state of the art many devices for preparing the end of the thread are described, for example in UK Patent No. 1480399, U.S. Pat. No. 3925975, German Patents Nos. 2350842 and 2350843 in the name of Stahlecker or in Application for U.S. Pat. No. 659,040 in the U.S.A.

In spinning machines of more recent design, along the thread path between the exit from the rotor and the reel onto which the thread is wound there is a slub-catcher which checks for irregularities in the thread produced and interrupts the latter when it detects an irregularity in the thread which exceeds its calibration values. This improvement enables a better-quality yarn to be produced as compared to conventional spinning machines.

There are thus three types of event which require the thread to be rejoined:

- when the thread is no longer produced in the rotor, for example due to the supply of roving running out or to irregularities or dirt in the spinning rotor;
- when the slub-catcher has come into operation, breaking off the thread;
- when the reel is completed and replaced by a new bobbin (removal cycle).

In all these cases a rejoining cycle is performed which essentially involves cleaning the rotor, preparing the roving, picking up and preparing the skein end of the thread on the reel side, restarting the rotor and resuming the supply, reintroducing into it the prepared skein end, reextracting the skein end joined to the newly-produced thread and resuming winding of the thread.

In the first two cases the skein end of the thread must be found and picked up on the still incomplete reel in production, whereas in the case of removing the completed reel which is replaced with a new bobbin there are two possibilities: either the new bobbin is mounted with thread already wound on—in which case the previous case applies—or the new bobbin is empty, mounted in position and then wound with initial coils of yarn picked up from an auxiliary reel on board the service trolley (as in U.S. Pat. No. 4539803 of Savio) or from the reel just completed. After this initial winding the procedure is as described for the previous cases.

The present invention relates to finding and picking up the skein end from the reel side and its delivery to the organs that prepare the skein end to perform the successive stages of the rejoining cycle. Finding and picking up the skein end on the reel is generally done by using a suction nozzle which explores a generator of the reel and by making the reel counter-rotate to yield up the wound thread to the said inlet.

After picking up the thread, the nozzle draws back and delivers it to the organs that perform the rejoining operations. This pickup operation is not always immediately successful, since the thread may offer resistance to unwinding itself properly and entering the nozzle, causing the subsequent operations, which are performed "blind", to fail.

According to German Application for Patent No. 3225375 of Schlafhorst, this problem in spoolers can be overcome by fitting the nozzle with a sensor which signals when the thread has been picked up, subordinating the successive stages to enablement by this sensor. If the sensor signals that the thread has not been picked up, the skein end search and pickup operation is repeated, without proceeding to the next stages of the thread joining cycle—which essentially comprises rejoining the two skein ends, one from the reel side, the other from the spool side—which would constitute a waste of time and therefore use factor of the machine. This measure, however, does not disclose either the position of the skein end on the edge of the nozzle and thus its correct delivery to the joining organs, or how much thread has been taken from the reel.

SUMMARY OF THE INVENTION

The invention overcomes the deficiencies in the prior art by providing an apparatus for delivering the skein end of a thread to a spinning machine, that includes a means for detecting whether the thread has been successfully grasped prior to attempting to deliver the thread to the spinning machine.

In general, the invention comprises means for unwinding a reel on which the thread is wound, a capturing means for capturing the skein end of the thread, a transferring means to transfer the thread from the capturing means to a device that returns the thread to the spinning machine, and a detecting means for detecting the presence of the thread in the transferring means.

Another aspect of the invention generally features an apparatus for rejoining the skein end of a thread wound on a reel, the thread having been disconnected from the reel due to one of a plurality of different events, the apparatus comprising: unwinding means for unwinding the reel; capturing means for capturing the skein end of the thread wound on the reel, cutting means for cutting a portion of the thread captured by the capturing means, the size of the cut portion varying in response to which of said plurality of different events caused said thread to become disconnected from the spinning machine; and rejoining means for rejoining a skein end of the thread remaining on the reel to the spinning machine.

DETAILED DESCRIPTION OF A PREFERRED EMBODIMENT

Figures 1, 2, 3:
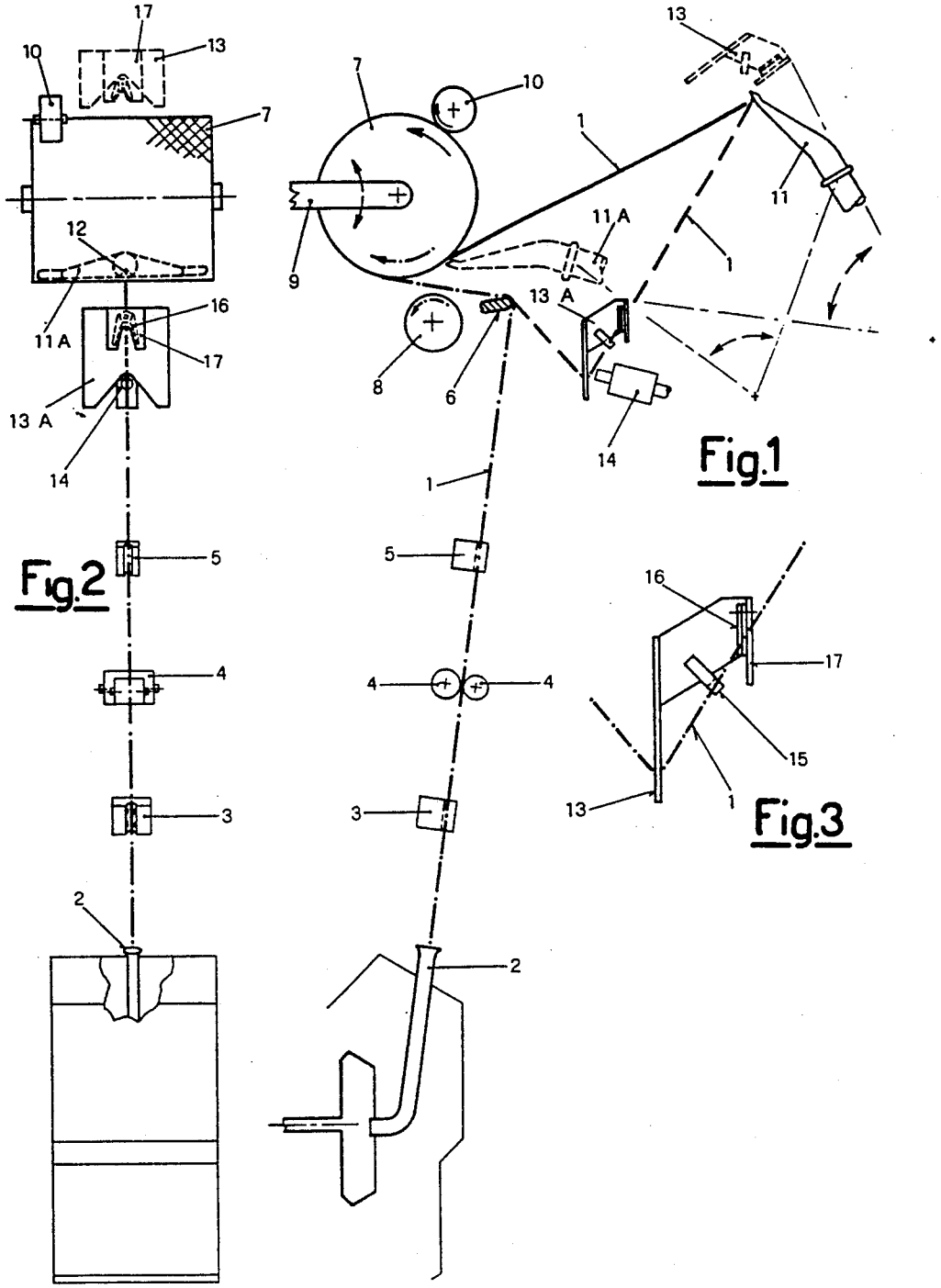
FIG. 1 illustrates a side view of an apparatus according to the present invention.
FIG. 2 is a front view of the apparatus shown in FIG. 1.
FIG. 3 is an enlarged side view of a portion of the apparatus shown in FIGS. 1-2.

The present invention relates to a device and a procedure for picking up the skein end of the reel of an open-end spinning machine which makes it possible not only to perform rejoining more efficiently, but also the removal operation, and furthermore obtain a better-quality yarn.

The present invention is described with reference to FIGS. 1 and 2, which show a typical embodiment thereof in an open-end spinning machine, for the purpose of illustration but in no way limiting. FIG. 1 is a side view of the spinning machine and FIG. 2*a* front view.

In its normal operation the open-end spinning machine produces thread 1, its path being shown by a dashed and dotted line, from pipe 2 leaving the spinning rotor it goes through slub-catcher 3, extraction rollers 4, thread-feeler 5, tightener 6 and then to reel 7, which collects the thread produced, driven by cylinder 8 in a clockwise direction shown by a dashed and dotted arrow.

The thread may be interrupted, as previously described, either because the rotor is no longer producing thread or because the slub-catcher has cut it. If a removal cycle must be performed, because the reel has been completed, the supply to the spinning rotor is usually stopped, the latter thus no longer producing thread, and the second case described applies.

Slub-catcher 3 may be of a mechanical, optical or capacitive type and operates a cutting organ or supply-interruption organ, not shown in the figure, and is linked to the machine's control unit to which it signals that the operation has taken place. Absence of the thread is detected by thread-feeler 5 and causes the spinning machine to stop and the service trolley to return. A blade (not shown) is placed between roller 8 and reel 7 which lifts the reel off its roller and brakes it until it stops.

On tile arrival of the service trolley, which performs the operations on spinning machines, it encounters the reel already stationary and positions itself in front of the spinning machine to perform the following work stages:

- reel-holder arm 9 is lifted further up also moving the reel away from the braking blade (these organs are known and described in Italian Patent No. 1146694 of Savio);
- a roller 10 is brought close and moves reel 7 to unwind the yarn wound onto it and at the same time the suction nozzle 11 is brought close to the reel into position 11A. Reel 7 rotates in an anti-clockwise direction shown by the unbroken arrow, unwinding thread 1 as shown by the unbroken line, which is picked up by the inlet nozzle, which may be withdrawn or brought close to the reel one or more times to improve the pickup action.

According to a preferred embodiment of the invention, the lower lip of nozzle 11 has a V notch 12, in which the thread locates itself in a precise position. This pickup stage is performed for a short time, at an unwinding speed generally less than one metre per second.

The nozzle withdraws to position 11, still under suction, while reel 7 is still unwinding; a V licker-in 13 is lowered into position 13A, bringing the thread 1 into the configuration shown by a dashed line to the thread preparation organ 14, with suction, for example as described in U.S. patent application Ser. No. 659,040. In the enlarged detail shown in FIG. 3, the V licker-in 13 has a thread sensor 15, for example of an infrared optical type, which signals the presence of thread 1, and a cutter 16, located behind the licker-in on a support 17, which also has a centering V-notch.

Thread sensor 15 is connected to the service trolley control unit, to which it sends signals to denote that the thread is present or absent.

If the thread is present, sensor 15, by means of the trolley control unit, causes thread 1, which continues to be unwound from reel 7, to be cut. The section downstream is taken up by suction by nozzle 11, while the skein end upstream of cutter 16 is picked up by suction by organ 14 which prepares the thread end in a known way. After having received and taken the thread, the organ that prepares the skein end moves into a position to deliver the skein end to the spinning rotor, according to the precedure described in U.S. patent application Ser. No. 659,040, while the reel continues to supply it with thread.

An important characteristic of the procedure according to the invention lies precisely in this stage of the cycle. It has in fact been found that in the case where interruption of the thread is due to the action of the slub-catcher, in order to obtain a better-quality thread it is necessary to remove from the skein end a greater quantity of thread as compared to that to be removed in the case where interruption of the thread is due to the spinning rotor.

As an indication, in the case where interruption is due to the rotor only 2-4 metres of thread need be removed to perform rejoining with a skein end of homogeneous characteristics, whereas if it is due to the slub-catcher 7-20 metres of thread must be removed. These values are given as a guide and relate to the spinning parameters and characteristics of the raw material. The total length of thread to be removed, in the case of interruption being due to the slub-catcher, is on average 2-3 times that to be removed in the case of interruption due to the rotor, in order to obtain a skein end with homogeneous characteristics for rejoining.

This difference may be attributed both to the fact that interruption of the thread by the slub-catcher occurs with a small but not negligible delay—especially in the case where the slub-catcher interrupts the supply of roving, allowing the fibres in the unwinder and supply rotor to run out—and to the fact that usually a major imperfection in the yarn is very often preceded by a section with minor irregularities, but still detrimental to the quality of the product.

Removing the end section of the thread before preparing it in device 14 thus translates into a longer or shorter controlled delay between delivery of the thread to preparer 14 and preparation of its end by the latter, which involves cutting and tapering its end part.

Alternatively it is possible to rotate roller 10 at different speeds in both cases, while maintaining a constant delay between delivery and preparation. If there is no thread in sensor 15, the trolley control unit interrupts the rejoining cycle and the operations of picking up with the nozzle and movement of licker-in 13 are repeated;

- in the event of a positive outcome thread preparer 14 is kept in position to pick up by suction the additional quantities of thread in the case where interruption of the thread is due to the slub-catcher;
- the rejoining cycle then proceeds as described in Application for U.S. Pat. No. 659,040 in the U.S..A.

The procedure and device according to the present invention thus enable preparation of the thread skein end for rejoining not only by tapering its end part, as in the previous patents referred to above, but also by ridding it of the section affected by the interruption of the thread in which very often there are irregularities before the interruption, concentrated in the section immediately upstream of it.

According to the present invention the thread sensor is used by placing it on licker-in 13 which supplies preparation device 14, which in turn removes the end section, checking not only that the thread has been picked up, but also that it is correctly delivered to the organs downstream of the nozzle, and giving to the removal of the faultly section a point of reference from which the length of the section eliminated can be determined with certainty.

Placing the sensor on V licker-in 13, which is also used in the removal cycle, also enables the removal cycle to be performed with the auxiliary thread under the control of the sensor in that position. In fact, spinning machines of this type may use a reel of auxiliary thread, which is picked up by organs other than the nozzles that pick up the skein end from the reel, but in this case too it is the V licker-in which brings the skein end to be prepared for the operation of rejoining the auxiliary thread to the singularized fibres in the rotor and resuming open-end spinning. Its sensor 15 is thus able to control all the possible rejoining operations, including those performed with auxiliary thread. In this case too the removal operation is allowed to proceed with the successive stages of the cycle only if sensor 15 detects that the auxiliary thread has been successfully picked up.

I claim:

1. An apparatus for delivering a skein end of a thread wound in a path and onto a reel to an apparatus for returning the skein end to a spinning machine, said apparatus for delivering comprising:

unwinding means for unwinding the reel on which the thread is wound;

suction means for capturing the skein end of the thread;

thread preparation means for removing a predetermined length of thread, wherein the predetermined length of thread is discarded, and for preparing the skein end of the thread for subsequent rejoining; and grasping means for grasping the thread after said thread has been captured by said suction means, said grasping means movable into a path of said grasped thread after said capture to bring said grasped thread facing said thread preparation means and within a predetermined distance of said thread preparation means;

wherein said grasping means comprises a first V-shaped notch and a second V-shaped notch adapted for positioning the grasped thread, wherein said first V-shaped notch has a different V-shape from said second V-shaped notch, and detecting means positioned therebetween for detecting and indicating the presence of the grasped thread grasped by said grasping means.

2. The apparatus of claim 1 wherein said means for detecting comprises an optical sensor positioned to detect the presence thread in said V-shaped notches.

3. The apparatus of claim 1 wherein said grasping means further comprises means for cutting the thread.

4. The apparatus of claim 1 wherein said means for detecting comprises an optical sensor.

5. The apparatus of claim 1, wherein said thread preparation means comprises a suction nozzle.

6. An apparatus for rejoining a skein end of a thread wound on a reel to a spinning machine, said thread having been disconnected from said spinning machine because of one of a plurality of different causes, wherein one of said plurality of different causes of thread disconnection comprises cutting said thread in response to an output from a thread quality measuring device operatively connected to the spinning machine, and wherein another of said plurality of different causes of thread disconnection comprises an interruption of a production of thread in said spinning machine, the apparatus comprising:

unwinding means for unwinding the reel on which the thread is wound;

capturing means for capturing the skein end of the thread wound on the reel;

cutting means for cutting a portion of the thread captured by said capturing means, wherein said cutting means cuts a longer portion of said thread if said thread was disconnected from the spinning machine due to said quality measuring device than the portion cut by said cutting means if said thread was disconnected from the spinning machine due to an interruption of the production of thread in the spinning machine; and rejoining means for rejoining a skein end of the thread remaining on the reel to the spinning machine.

* * * * *